United States Patent [19]

Soltermann et al.

[11] Patent Number: 5,065,637

[45] Date of Patent: Nov. 19, 1991

[54] ADJUSTING DEVICE AND ADJUSTABLE TEXTILE FIBER CARDING APPARATUS

[75] Inventors: Roland Soltermann; Peter Fritzsche, both of Winterthur; Kurt Müller, Schlieren, all of Switzerland

[73] Assignee: Maschinenfabrik Rieter AG, Winterthur, Switzerland

[21] Appl. No.: 489,530

[22] Filed: Mar. 7, 1990

[30] Foreign Application Priority Data

Mar. 8, 1989 [DE] Fed. Rep. of Germany ..... 3907517
Dec. 5, 1989 [DE] Fed. Rep. of Germany ..... 3940229

[51] Int. Cl.[5] ..... D01G 15/28; D01G 15/46; F16M 7/00

[52] U.S. Cl. ..... 74/99 R; 19/98; 19/106 R; 248/619

[58] Field of Search ..... 74/99 R; 19/98, 105, 19/106 R; 248/619

[56] References Cited

U.S. PATENT DOCUMENTS 4,384,388 5/1983 Mondini ..... 19/106 R X

FOREIGN PATENT DOCUMENTS 691064 4/1940 Fed. Rep. of Germany ..... 248/619

*Primary Examiner*—Leslie A. Braun
*Assistant Examiner*—Scott Anchell
*Attorney, Agent, or Firm*—Burns, Doane, Swecker & Mathis

[57] ABSTRACT

Textile fiber carding apparatus is provided with an adjusting system for carrying out linear adjusting movements which are at least esentially independent of friction, and free from jerks and oscillations. The system includes a carrier (20) for the object (12) (e.g., the doffer) to be adjusted and an actuating mechanism (40) in contact with the carrier. The carrier (20) is supported at at least two positions spaced apart from each other in the direction of adjustment on respective supporting devices (26, 26.1). At least one of the supporting devices is formed by a generally cylindrically shaped bellows (28) filled with a bubble free incompressible fluid and is secured at its one end face to the carrier (20) and at its other end face to a foundation (24). At least one flat spring (34, 34.1) is secured at its one end to the foundation (24) and its other end to the carrier (20). One or more addition supporting devices (26, 26.1) may be arranged to permit freedom of movement in the adjusting direction in a manner at least substantially free of friction.

27 Claims, 4 Drawing Sheets

ADJUSTING DEVICE AND ADJUSTABLE TEXTILE FIBER CARDING APPARATUS

FIELD OF THE INVENTION

The present invention relates to an adjusting device for carrying out linear adjusting movements which are at least essentially independent of friction, and free from jerks and oscillations. In particular the present invention deals with the problem of adjustably supporting the doffer of a card in relation to the main card cylinder so that it can be adjusted in a relatively small linear range (for example 0–1 millimeter).

BACKGROUND OF THE INVENTION

When a cotton fiber carding machine is in operation, the carded fibers on the spikes of the clothing of the main card cylinder are conveyed to the doffer and transferred to it in the form of a fine card web. The doffer, in the same way as the main cylinder, is a cylindrical element which has a spiked clothing on its surface. These spikes on the components may be in the form of teeth or wires.

The exact setting of the doffer relative to the main cylinder is normally fixedly preset in the manufacturer's works. However, there is a range of circumstances in the practical operation of a card when it would be desirable to make the clearance between the spikes of the clothing and the main cylinder adjustable, in order to achieve ideal carding and to ensure an ideal transfer of the carded fibers to the doffer. By this means, the starting operation of a card could be better controlled, temperature dependent elongations could be compensated and adjustments to the staple length could be effected. The problem lies in the fact that this adjustment must be carried out with delicacy as well as friction free and without jerks, without the support of the object tending to oscillate. The achievement of an adjustment of this type is very difficult in practice because of the static friction frequently encountered with mechanical devices. The doffer is namely a relatively heavy structure, so that the adjustment of the latter in an arrangement with very high friction tends to occur with a certain jerk or jolt as soon as the state of rest is converted into a movement to the desired position. This phenomenon is known as so-called stick-slip. In order to overcome this problem one could attempt to support the doffer on rollers, so that the friction is at a minimum. However, the risk then exists that the arrangement easily tends to oscillation.

SUMMARY OF THE INVENTION

A preferred form of the present invention enables sensitive, friction and jerk-free adjustment of an object (a doffer in the preferred case) at a reasonable price, without the support tending to oscillate.

A construction in accordance with the invention may include a carrier for the object to be adjusted. This carrier is supported at at least two positions spaced apart from each other in the direction of adjustment on respective supporting devices. At least one of the supporting devices comprises a generally cylindrically shaped bellows filled with a bubble free incompressible fluid and secured at its one end face to the carrier and at its other end face to a foundation. At least one flat spring is provided which is secured at its one end to the foundation and at its other end to the carrier. The other supporting device or the other supporting devices is or are so arranged that it or they permit freedom of movement in the adjusting direction in a manner at least substantially free of friction.

The other supporting device or the other supporting devices should prevent a movement and oscillating of the carrier in other directions. The aforementioned leaf spring also serves this purpose.

The leaf spring can be arranged in the adjustment direction in front of or behind or laterally of the associated bellows, however its plane, i.e. a perpendicular to this plane, should point in the direction of adjustment.

A cylindrical bellows has the characteristic that it is unstable in three directions perpendicular to each other, namely in the axial direction of the bellows and in two directions perpendicular to each other in a plane perpendicular to the cylinder axis.

The bellows is stiff in the axial direction through the provision of an incompressible bubble-free liquid, which is optionally under pressure in the interior of the bellows which is made from metal in accordance with the invention. However, it retains its instability in the perpendicular directions on the transverse plane. Through the addition of one or preferably two flat spring(s) parallel to each other, this instability can be limited to one direction with little complexity. The use of two supporting devices for the carrier which have a space from each other make it possible to displace the carrier in the desired adjustment direction without problems of static friction arising. The structure is, however, rigid in the transverse direction of the carrier, that is, in the direction which is transverse to the adjusting direction and rigid in the axial direction of the bellows, so that undesirable oscillations are not to be expected.

It should be stated at this point, that the leaf spring should be mounted on the base or on the carrier in such a way that a displacement of the carrier relative to the foundation in the plane running transversely to the cylinder axis and in a direction which is transverse to the adjusting direction is prevented. For example, this can be achieved when the or each leaf spring is secured at two spaced apart points to at least one of the two parts, carrier or foundation. On the other respective part (foundation or carrier), the flat spring only requires fastening on one point, insofar as means are present which exclude a tipping movement of the carrier relative to the foundation. Otherwise, a fastening on two points is also preferred here.

The other supporting device could, for example consist of a link connected at one of its two ends to the foundation or to the carrier, preferably a link which with the leaf spring permits a parallelogram movement of the carrier relative to the foundation. The link should be fastened on both of its two ends via friction reducing bearings (for example ball bearings or roller bearings) to the carrier and to the foundation or base. With an elongated construction to the pivot axles of the link on the carrier and on the foundation as well as a broad design of the link transverse to the carrier, the link can also contribute to ensuring the transverse stability of support of the carrier.

The at least two supporting devices, are preferably of the same construction, that is, each consists of a bellows filled with an incompressible fluid and at least one leaf spring.

Even though two supporting devices are adequate to accomplish the task in accordance with the invention, it is preferable, especially when the carrier is designed to be relatively wide, to provide several supporting devices, for example three supporting devices which are arranged on the corners of a triangle, or four supporting devices which are arranged on the four corners of a rectangular carrier.

In a preferred embodiment the actuating mechanism is arranged between at least two supporting devices. It can consist of an eccentric cam and a working surface on the carrier which cooperates therewith.

In order to minimise any friction at this point, the working surface on the carrier can be formed by a ball bearing. Alternatively, the eccentric cam can have a circular surface, which is formed by the outer ring of a ball bearing or of a rolling element bearing.

An embodiment which is particularly preferred is distinguished by the fact that the supporting devices and the leaf springs form an acute angle with the carrier and are inclined backwards in the adjusting direction.

With this embodiment the inherent weight of the doffer leads to the tendency to move backwards in the direction opposite to the adjusting direction, so that a certain contact pressure exists between the cam and the associated working surface. This tendency of the doffer to move away from the main cylinder offers a high safety margin of the arrangement, as the risk of the spikes of the clothing of the doffer and the main cylinder coming into contact with each other, which can lead to serious mechanical damage, is considerably reduced.

In order to increase this safety further, it is preferable to provide a prestressing spring on the carrier opposite to the adjusting direction. The employment of a spring of this kind can be used either as a substitute for the possibility of exploiting the inherent weight of the doffer mentioned immediately above or additionally thereto. The provision of a spring of this type leads to a force which attempts to press the doffer away from the main cylinder, does not, however, lead to any significant frictional forces, even though the contact pressure between the actuating mechanism and the carrier is slightly increased. The spring just mentioned can, for example, be a compression coil spring, or it can also be made from rubber or from a rubber-like material.

If it is desired to be absolutely certain that a contact between the doffer and the main cylinder is completely excluded, then this safety can be achieved through an adjustable mechanical stop.

In this connection, a preferred embodiment of the invention is distinguished by the fact that the operating mechanism consists of two movably coupled circular eccentric cams, which work in conjunction with the opposite sides of a follower provided on the carrier. With this embodiment the eccentric cam provided on the side of the follower facing main cylinder functions as the adjustable mechanical stop, whereby the adjustment of this eccentric cam takes place simultaneously with the adjusting of the other eccentric cam which brings about the adjusting movement.

An even simpler solution with only one eccentric cam is distinguished by the fact that this cam, which preferably has a circular cam contour, is arranged in a yoke provided on the carrier, with the rear surface of the yoke (as seen in the adjusting direction) which cooperates with the eccentric cam, preferably having a small clearance from the latter.

The actuating mechanism can however also comprise a thermally extensible device, e.g. an electrically heatable metal rod.

BRIEF DESCRIPTION OF THE DRAWINGS

The invention will now be explained in more detail with the aid of the drawing, which shows.

DETAILED DESCRIPTION OF THE PREFERRED EMBODIMENTS

Figure 1:
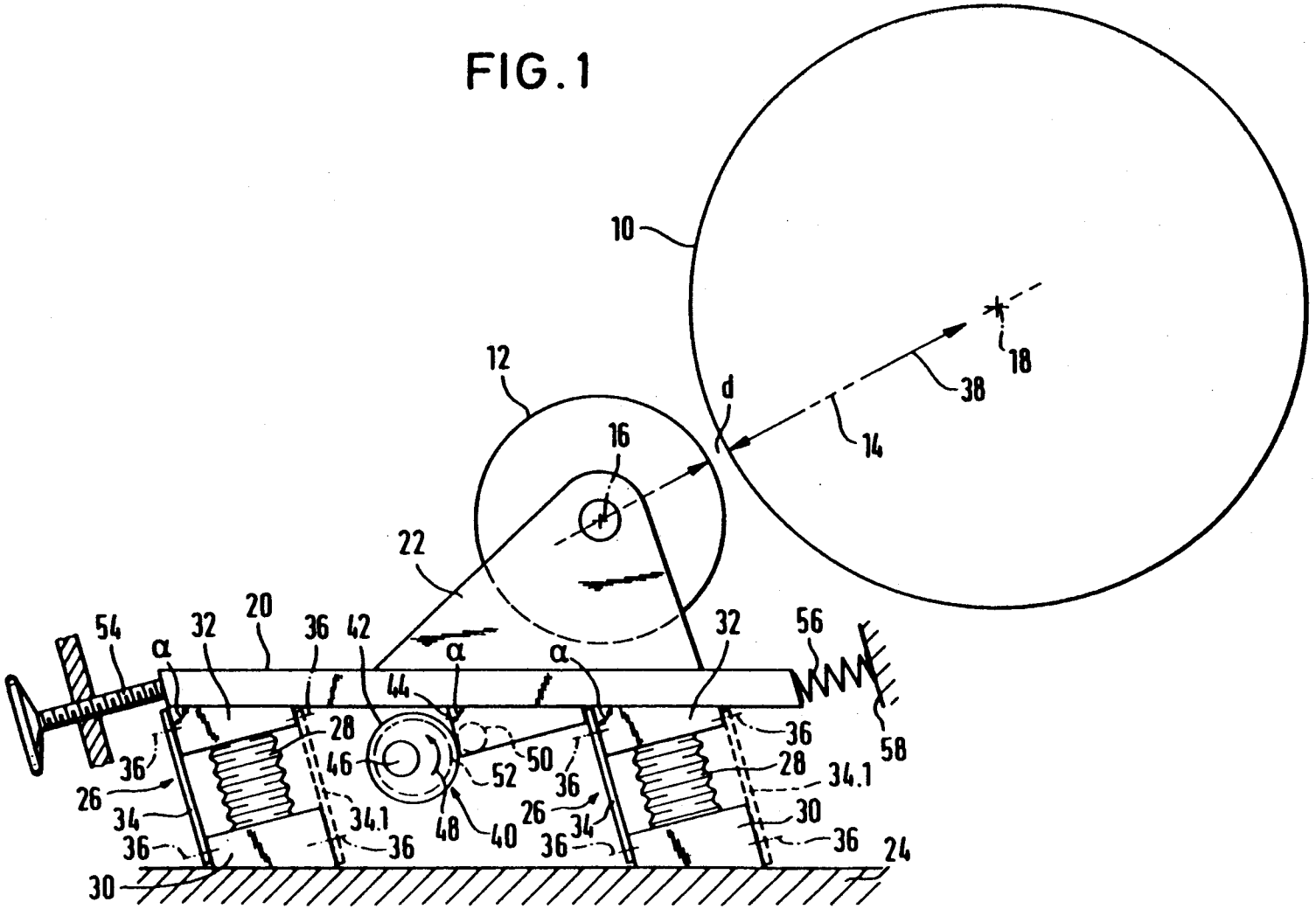
FIG. 1 a perspective side view of a first embodiment of the adjusting device according to the invention, FIG. 2 a perspective side view of a variant of the embodiment of the adjusting device of FIG. 1, FIG. 3 a side view of a variant of the operating mechanism, whereby only the parts necessary for the explanation of the operating mechanism are shown, FIG. 4 a side view corresponding to FIG. 3, however of a further variant, and FIG. 5 a side view corresponding to FIG. 1 however of a modified embodiment in which the actuating mechanism is formed as a heatable metal rod.

FIG. 1 shows a part of a card in a side view, whereby the main cylinder 10 and the doffer 12 are easily recognised. The reference symbol 14 refers to an imaginary connecting line between the axis 16 of the doffer and the axis of rotation 18 of the main cylinder. The axle of rotation 18 of the main cylinder is fixed in the card frame. The doffer 12 is rotatably held on the carrier 20 by means of axle carriers 22 at the end faces of the doffer 12, of which only one of these axle carriers is visible. Both the doffer 12 as well as the main cylinder 10 carry wire clothing on their cylindrical surfaces, the working spikes of which must have a small clearance d from each other, with this clearance being adjustable, if only in a very limited range. The carrier 20 is supported on a base or foundation 24 by means of four supporting devices 26 which are spaced from each other and of which only two are visible in the drawing. The four supporting devices are arranged on the four corners of the carrier which is rectangular when viewed from above. For this reason the two further supporting devices in FIG. 1 are not visible (as they lie behind the illustrated supporting devices). The foundation 24 is a part of the card frame.

Each supporting device consists essentially of a cylindrical metal bellows 28, which is fastened on its end faces to the corresponding fastening plates 30 or 32. With these plates, 30 and 32 each bellows is rigidly fixed e.g. screwed to the foundation 24, and to the carrier 20 respectively. Each supporting device has at least one leaf spring 34, which is fastened to the plates 30 and 32 and thence effectively also to the carrier 20 and to the foundation 24. Each leaf spring 34 is fastened to the respective plate by means of screws 36, whereby in this example at least two screws are provided on each plate, so that the leaf spring, which has a certain extent in a plane perpendicular to the plane of the drawing, ensures adequate stability for the support of the carrier 20 in the direction perpendicular to the plane of the drawing.

In addition to the leaf spring 34, a further leaf spring 34.1 can be arranged on the opposite side of the bellows and likewise fastened to the plates 30, 32 or to the base 24 and to the carrier 20. This means that the springs 34, 34.1 are arranged in the adjusting direction of the doffer in front of and behind the respective bellows, with the adjusting direction, as shown by the arrow 38, being directed from the axis of the doffer 12 to the axis of the main cylinder 20.

In order to effect the adjustment of the doffer in the adjusting direction 38, an actuating mechanism 40 is situated between the two supporting devices 26. In the present example, the actuating mechanism 40 effects a displacement of the carrier in the direction of the arrow 38 because of the inclination of the leaf springs and of the bellows. The adjusting direction must not be arranged in this way unconditionally, it can with advantage deviate from the connecting line between the axis of the doffer and the axis of the main cylinder. This then leads to a deviation in the 1 to 1 relationship between the adjusting movement of the actuating mechanism and the alteration in the clearance d, which is a little more complicated but also less sensitive.

In the present case, the operating mechanism consists of an eccentric cam 42 and a working surface 44 which cooperates with it. The cam 42 is rotatable by means of the axle 46 in the direction of the arrow 48, whereby the rotary movement is produced by an associated control motor or a handwheel on the shaft 46. In order to avoid friction between the eccentric cam 42 and the working surface 44, the working surface itself can be formed by a ball bearing or a rolling element bearing, which is indicated by the dotted line 50. Alternatively, the circular outer surface of the eccentric cam 42 can be formed by the outer race of a ball or rolling element bearing, which is likewise indicated with a dotted line and the reference symbol 52.

Finally, it can be seen from the drawing that the leaf springs, the bellows and the working surface 44 respectively form an acute angle $\alpha$ with the carrier 20 and are inclined backwards in the direction of adjustment. This means that with the adjustment of the carrier, the leaf springs 34, 34.1 are turned on, i.e. rotated about, their lower ends in the clockwise direction, so that the carrier itself, because of the inclined position towards the rear, is not only adjusted, but is also raised. The raising however, can be completely neglected with the small range of adjustment.

It is clear that the operating mechanism 42 can be formed otherwise, for example, through a screw 54 which contacts the rear end of the carrier and is preferably likewise inclined in accordance with the angle $\alpha$. The screw 54, which is rotatably held in a screw thread provided in the foundation, can engage with a ball nut in the carrier, whereby the friction is reduced and in addition, the carrier is positively held in both directions, that is, in the adjusting direction and in the opposite direction.

It is also advantageous with the inclined arrangement that the weight of the arrangement formed by the doffer and carrier attempts to move the doffer and the carrier against the adjusting direction 38, that is, to increase the clearance d. Alternatively or additionally to this a spring 56 can be used which is braced at one end on part 58 of the foundation and at the other end on the carrier 20 and which presses the carrier in the direction away from the main cylinder.

Figure 2:
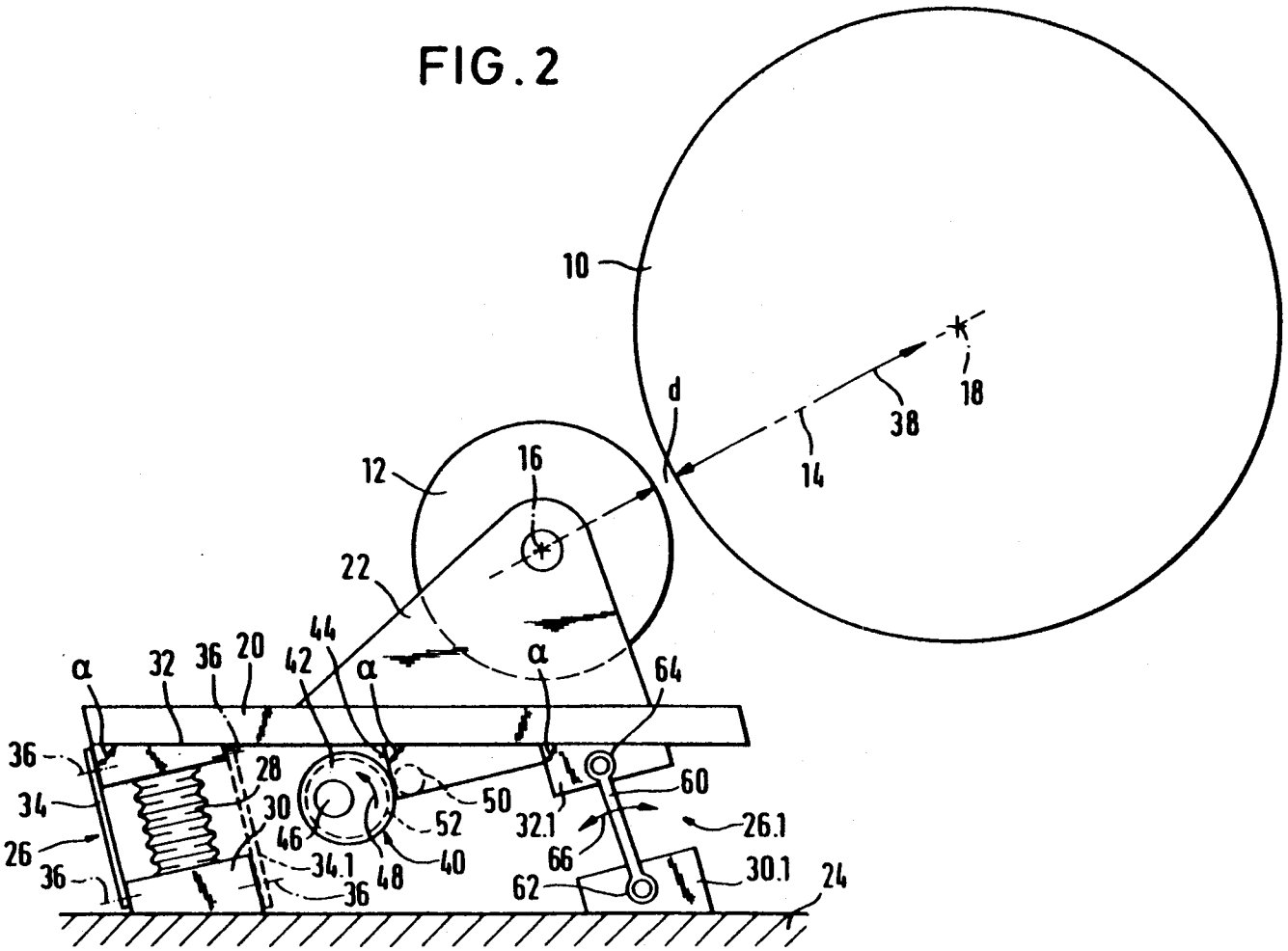

FIG. 2 shows a variant of the adjusting device according to the invention which is very similar to the embodiment shown in FIG. 1. The difference is actually only that here the two front supporting devices 26.1 of which only the one in FIG. 2 can be seen, do not consist of bellows and flat springs, but of links 60, which are pivoted at their two ends 62 and 64 on the plates 30.1 and 30.2 via appropriate ball bearings. The links 60 behave geometrically at least substantially in the same way as the leaf springs 34 and 34.1 and with this, form a type of parallelogram linkage. Because ball bearings are provided between the ends 62 and 64 of the link 60 and the plates 30.1 and 32.2, a movement of the link in the direction of the arrow 66 can take place, without this leading to appreciable friction. An important contribution is also made to the transverse stability of the adjusting device through a broad execution of the connecting rod 60 in the direction perpendicular to the plane of the drawing. The front end of the carrier 20 is nevertheless correctly determined which is an advantage for the accuracy of adjustment of the clearance d.

Figure 3:
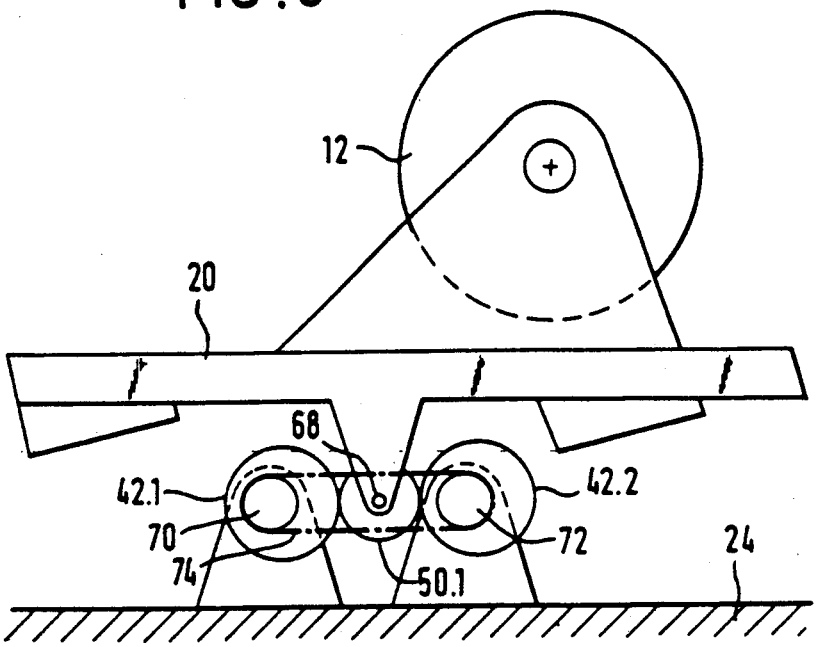

FIG. 3 likewise shows in a side view, a variant of the actuating mechanism, which here consists of two circular eccentric cams 42.1 and 42.2, which are arranged on opposite sides of a follower 50.1 formed as a ball bearing. The follower 50.1 is pivotally mounted by means of an axle 68 on the carrier 20. The eccentric cams 42.1 and 42.2 are pivotally mounted on the foundation 24 via the axles 70 and 72 respectively. A continuous chain 74 runs round the two axes 70 and 72 and is positively connected with the two eccentric cams 42.1 and 42.2, for example via gear wheels fitted to these. Consequently, an adjustment of one of the eccentric cams 42.1 leads to adjustment of the further eccentric cam 42.2 in the same direction, whereby the space between the confronting sides turned of the two eccentric cams remains constant. Consequently, the eccentric cam 42.1 causes the desired adjusting movement of the carrier 20 and the cam 42.2 works against this as a mechanical stop, which is adjusted simultaneously with the eccentric cam 42.1 and prevents the doffer 12 unintentionally coming into contact with the main cylinder, for example in the case of a blow. (FIG. 3, not shown for the sake of simplicity.)

The clearance between the two eccentric cams 42.1 and 42.2 can have a dimension which is a little larger than the diameter of the follower 50.1 so that the normal case only the eccentric cam 42.1 is engaged with the latter in order to prevent friction. The follower 50.1 can also be formed by a two piece ball bearing, whereby the eccentric cam 42.1 works in conjunction with one ball bearing and the eccentric cam 42.2 cooperates with the other ball bearing. This arrangement makes certain that no disturbing friction arises and also, that the carrier 20 is held free from play between the two eccentric cams 42.1 and 42.2.

Figure 4:
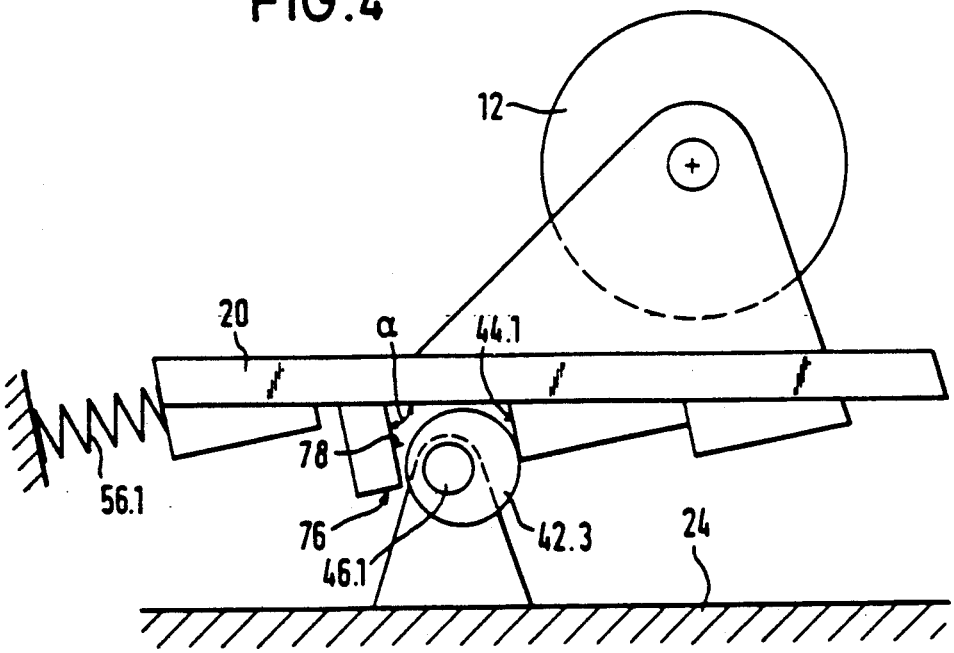

The arrangement according to FIG. 4 represents a type of kinematic inversion according to FIG. 3. Here, there is an eccentric cam 42.3 which is also held on the foundation 24 by means of an axle 46.1, also corresponding to the eccentric cam 42 of FIG. 1, in a yoke 76 of the carrier 20, whereby the front face of the yoke 76 forms a working surface 44.1 for the eccentric cam and the other surface 78 of the yoke has a slight clearance from the confronting side of the eccentric cam. It is seen immediately that the eccentric cam 42.3 works in conjunction with the working surface 44.1 in the same way as the eccentric cam 42 of the embodiment of FIG. 1 cooperates with the working surface 44 of FIG. 1. The surface 78 of the yoke 76, however, prevents the unintentional wandering of the doffer 12 in the direction of the main cylinder. The clearance between the eccentric cam 42.3 and the surface 78 remains constant with the displacement of the circular eccentric cam 42.3. Because of this clearance, no disturbing friction exists here.

FIG. 4 also shows that the spring 56.1 can be arranged on the other end of the carrier, where it is preferably arranged as a tension coil spring.

It should also be explained that the spring 56.1 can also be arranged as a compression spring. In this case the spring then has the task of prestressing the doffer in the direction towards the main cylinder 10. In this case the eccentric cam 42.3 would work in conjunction with the surface 78 to press the carrier 20 in the direction away from the main cylinder.

With this embodiment the surface 44.1 would be superfluous, as the eccentric cam 42.3 would prevent an unintentional movement of the doffer 12 in the direction of the main cylinder. Attention must be given with this embodiment that the coil spring 56.1 is sufficiently strong to prestress the carrier 20 in the adjusting direction. However, this should not present any difficulties. An embodiment of this type has the advantage that it is relatively simple but very effective. According to the invention, the angle $\alpha$ in FIG. 4 could be greater than 90 degrees, whereby the angle of inclination of the supporting device or of the leaf spring or of the link should be selected to correspond with the increased value of the angle $\alpha$. With this change, the inherent weight of the carrier 20 would attempt to move the doffer 12 in the direction of the main cylinder, so that the spring 56.1 would be superfluous.

Figure 5:
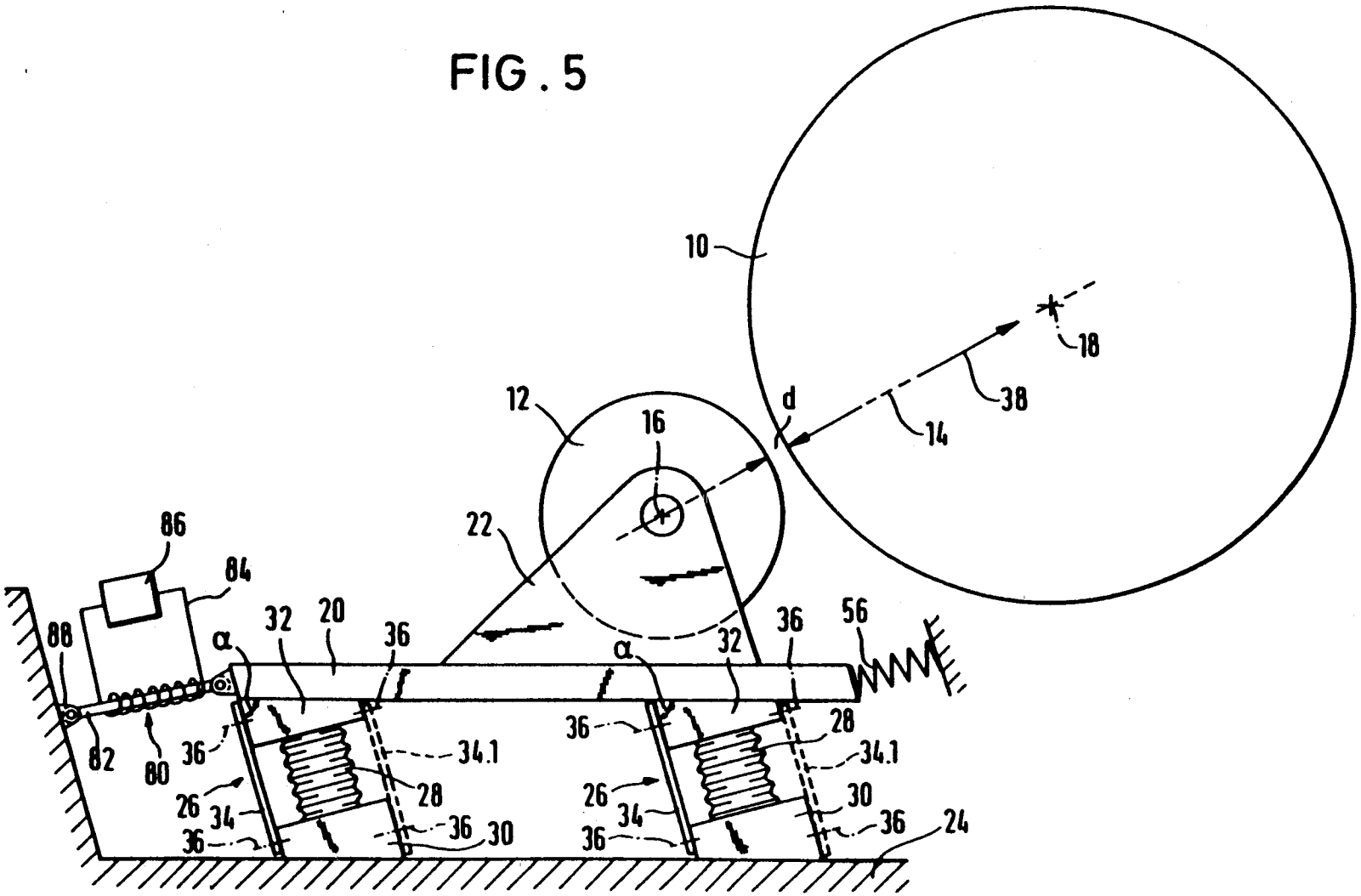

FIG. 5 shows an arrangement similar to FIG. 1 in which the actuating mechanism is however formed as a thermally extensible device 80. In this example the thermally extensible device is formed by a metal rod 82 which is heated by means of a controllable electric heating wire 84, with the expansion of the rod being proportional to its temperature and being determined by the temperature of the heating wire, which can be changed by the control circuit 86. The rod 82 is pivotally connected or secured at its one end to the carrier 20 and at its other end to the foundation 24 so that it also serves for a return movement on cooling down.

Finally, it must be explained that the embodiment according to the invention is not limited to a doffer only, but is also suitable for other applications with textile machinery and also for other purposes, for example, it can be used for supporting the adjustable mirrors of an interferometer.

What is claimed is:

1. An adjusting device for carrying out linear adjusting movements which are at least essentially independent of friction, and free from jerks and oscillations, comprising:

a carrier for an object to be adjusted;

an actuating mechanism in contact with the carrier for reciprocating the carrier along a path in a forward direction whereby the object can be proximally adjusted, and a rearward direction whereby the object can be distally adjusted;

the carrier being supported at at least two positions spaced apart from each other along said path on respective supporting devices, at least one of the supporting devices comprising a generally cylindrically shaped bellows filled with a substantially incompressible medium, the bellows being secured at one end face thereof to the carrier and at another end face thereof to a foundation; and at least one leaf spring being secured at one end thereof to the foundation and at another end thereof to the carrier, the leaf spring and another one of the supporting devices permitting freedom of movement along said path in a manner substantially free of friction.

2. The adjusting device according to claim 1, wherein the bellows is located forward of the leaf spring.

3. The adjusting device according to claim 1, wherein two leaf springs are associated with the bellows and are respectively arranged on opposite sides of the bellows along said path.

4. The adjusting device according to claim 3, wherein the actuating mechanism comprises an eccentric cam and a working surface on the carrier which cooperates therewith.

5. The adjusting device according to claim 4, wherein the working surface comprises a ball bearing.

6. The adjusting device according to claim 4, wherein the eccentric cam has a curved cam contour.

7. The adjusting device according to claim 4, wherein the eccentric cam has a circular surface which is formed by an outer ring of a ball bearing or rolling element bearing.

8. The adjusting device according to claim 4, wherein the working surface is inclined in the rearward direction.

9. The adjusting device according to claim 4, wherein the eccentric cam has a circular cam contour arranged in a yoke provided on the carrier, the yoke having a rear surface facing the forward direction which cooperates with the eccentric cam, the eccentric cam being located between the rear surface and the working surface.

10. The adjusting device according to claim 9, wherein the cam is spaced form the rear surface by a small clearance.

11. The adjusting device according to claim 1, wherein the actuating mechanism is arranged between the at least two supporting devices.

12. The adjusting device according to claim 1, wherein the supporting devices and the leaf spring form an acute angle ($\alpha$) with the carrier and are inclined in the rearward direction.

13. The adjusting device according to claim 1, further comprising a biasing spring which biases the carrier in the rearward direction.

14. The adjusting device according to claim 13, wherein the biasing spring is made from rubber or from a rubber-like material.

15. The adjusting device according to claim 1, further comprising a biasing spring which biases the carrier in the rearward direction, the biasing spring being opposed by the actuating mechanism.

16. The adjusting device according to claim 1, wherein the actuating mechanism comprises two movable kinematically coupled circular eccentric cams which work in conjunction on opposite sides of a follower provided on the carrier.

17. The adjusting device according to claim 1, wherein the supporting devices include at least one link which is pivotally connected at respective ends thereof to the foundation and to the carrier.

18. The adjusting device according to claim 1, wherein the actuating mechanism comprises a thermally extensible device, for example of an electrically heatable metal rod.

19. The adjusting device according to claim 18, wherein the thermally extensible device comprises an electrically heatable metal rod.

20. The adjusting device according to claim 1, further comprising the object, the object being a doffer adjustable relative to a main cylinder of a carding machine.

21. The adjusting device according to claim 1, wherein the leaf spring is located forward of the bellows.

22. The adjusting device according to claim 1, wherein the leaf spring is located laterally of the bellows with respect to said path.

23. The adjusting device according to claim 1, further comprising a biasing spring which biases the carrier in the rearward direction, movement in the rearward direction under bias from the biasing spring being permitted on actuation of the actuating mechanism.

24. The adjusting device according to claim 1, further comprising a textile fiber carding apparatus which includes a main cylinder and a doffer adjustable in the adjusting direction relative to the main cylinder, the doffer being supported on the carrier of the adjusting device.

25. The adjusting device according to claim 1, wherein the medium comprises a bubble-free liquid.

26. An adjustable mounting system for a heavy machine component which is to be moved through a small adjustment distance having a generally horizontal component with minimal friction and freedom from jerks and oscillations, comprising:

a stationary base;

a carrier for said machine component spaced above said base;

a bellows extending between said base and said carrier and being deflectable to permit slight movements of said carrier relative to said base in a direction having a generally horizontal component, said bellows being filled with a substantially incompressible fluid to transmit a weight load from said carrier to said base; and means for applying an adjusting force to said carrier in a direction having a generally horizontal component to deflect said bellows and move said carrier relative to said base.

27. Textile fiber carding apparatus comprising:

a carding machine member having a surface portion which is movable through a closed path and which is covered with protruding elements for contacting the textile fibers being carded;

a rotatable doffer disposed in closely spaced relation to said closed path and having protruding elements on its surface for receiving the textile fibers from the protruding elements on said member; and adjustable mounting means for mounting said doffer so that its position relative to said carding machine may be changed by small amounts to adjust the cooperative relation between the protruding elements on said carding machine member and the protruding elements on said doffer, said adjustable mounting means including stationary base means;

moveable carrier means carrying said doffer for rotation thereon;

coupling means for supporting said carrier means on said base means, said coupling means comprising bellows means filled with a substantially incompressible fluid and being disposed to transmit weight from said carrier means to said base means while permitting small movements of said carrier means relative to said base means, and a leaf spring secured at one end portion thereof to said carrier means and secured at an opposite end portion to said base means; and means for moving said carrier means relative to said base means with deflection of said bellows means and said leaf spring.

* * * * *